US008973609B2

(12) United States Patent
Hilzendegen et al.

(10) Patent No.: US 8,973,609 B2
(45) Date of Patent: Mar. 10, 2015

(54) VALVE ASSEMBLY

(75) Inventors: Philipp Hilzendegen, Weiskirchen (DE); Peter Bruck, Althornbach (DE); Hermann Albert, Lebach (DE)

(73) Assignee: Hydac Fluidtechnik GmbH, Sulzbach/Saar (DE)

( * ) Notice: Subject to any disclaimer, the term of this patent is extended or adjusted under 35 U.S.C. 154(b) by 346 days.

(21) Appl. No.: 13/261,264

(22) PCT Filed: Oct. 14, 2010

(86) PCT No.: PCT/EP2010/006289

§ 371 (c)(1), (2), (4) Date: Apr. 13, 2012

(87) PCT Pub. No.: WO2011/045063

PCT Pub. Date: Apr. 21, 2011

(65) Prior Publication Data

US 2012/0199765 A1 Aug. 9, 2012

(30) Foreign Application Priority Data

Oct. 16, 2009 (DE) ..... 10 2009 049 548

(51) Int. Cl.
*F15B 13/04* (2006.01)
*F15B 11/05* (2006.01)

(52) U.S. Cl.
CPC ..... *F15B 11/05* (2013.01); *F15B 2211/40515* (2013.01); *F15B 2211/455* (2013.01); *F15B 2211/46* (2013.01); *F15B 2211/50536* (2013.01); *F15B 2211/50572* (2013.01)
USPC ..... 137/625.6; 137/596.14; 251/55

(58) Field of Classification Search
USPC ..... 137/625.6, 115.03, 115.09, 115.05, 137/115.06, 115.07, 115.14, 115.15, 137/115.16, 115.18, 500, 501, 504, 454.5, 137/596.14; 251/28, 55
See application file for complete search history.

(56) References Cited

U.S. PATENT DOCUMENTS

| | | | | |
|---|---|---|---|---|
| 6,799,599 | B2 * | 10/2004 | Hoffmann | 137/115.03 |
| 6,966,329 | B2 * | 11/2005 | Liberfarb | 137/115.05 |
| 7,063,100 | B2 * | 6/2006 | Liberfarb | 137/115.08 |
| 8,662,097 | B2 * | 3/2014 | Imhof et al. | 137/115.1 |

FOREIGN PATENT DOCUMENTS

| | | |
|---|---|---|
| DE | 68908317 | 8/1993 |
| DE | 19744337 | 4/1999 |
| DE | 10039936 | 3/2002 |
| DE | 10322585 | 12/2004 |
| DE | 102005059240 | 6/2007 |
| EP | 0361613 | 4/1990 |

* cited by examiner

*Primary Examiner* — Craig Schneider
*Assistant Examiner* — Craig J Price
(74) *Attorney, Agent, or Firm* — Roylance, Abrams, Berdo and Goodman LLP

(57) ABSTRACT

A valve assembly for regulating the pressure of a pressure medium (2) of a pressure medium pump (3) to at least one first consumer (4) includes a pilot-controlled pressure control valve (5) with a main piston (6) acted on by the pressure medium (2) and a pilot piston (7). A pressure chamber (8) between a piston back side (9) of the main piston (6) and the pilot piston (7) can be relieved. A relief valve (10) is connected in a fluid-conducting manner to the pressure chamber (8), opens when pressure at the load sensor (LS) represents an out-of-operation mode of the consumer (4), and recirculates pressure medium (2) having a low pressure to a pressure medium reservoir (11) or to the pressure medium pump (3). The relief valve (10) closes when the pressure at the load sensor (LS) represents an in-operation mode of the consumer (4).

8 Claims, 8 Drawing Sheets

VALVE ASSEMBLY

FIELD OF THE INVENTION

The invention relates to a valve assembly for pressure control of a pressure medium from a pressure medium pump to at least one first consumer, comprising a pilot-operated pressure control valve. The valve includes a main piston pressurized by the pressure medium and a pilot piston. A pressure chamber between a back of the main piston and the pilot piston can be relieved.

BACKGROUND OF THE INVENTION

Typically, pressure control valves are used if the travel speed of a hydraulic cylinder or the speed of a hydraulic motor is to be kept constant independently of the pressure difference prevailing on a flow valve, independently of the temperature or viscosity of a pressure medium used for this purpose and independently of the load to be moved. The pressure medium flow that has not been routed through the pressure control valve is drained via a pressure limiting valve for a pressure medium pump with relatively great losses in performance and pressure.

To minimize such performance losses, linking a pressure control valve that works as a pressure compensator to a load sensor on a consumer, for example, of a hydraulic cylinder, such that the LS (load sensing) pressure from the load sensor of the consumer prevails in a pressure chamber downstream of the pilot piston, is known. In particular, the pump pressure can be compared essentially to the spring pretensioning on the control piston plus the pressure on the consumer (LS). When the consumer is in the off-position, the pressure medium can be drained with less energy loss than in use with a pressure limiting valve. The performance loss of these known pilot-operated pressure control valves with a pressure compensator function, however, cannot be completely avoided.

DE 103 22 585 A1 describes, for example, a valve assembly for pressure control of a pressure medium from a pressure medium pump to a consumer, wherein a main control valve can be able to be hydraulically actuated by a pilot valve. In particular, the document describes a valve module system with at least one valve housing that, on its opposite ends both to the inside and to the outside on the periphery and in the housing interior, has standardized nominal sizes for mounting of other valve components. Such valve components can be a valve piston, an energy store, a pilot valve, and at least one fluid port for securing the valve assembly designed as a screw-in cartridge in the vicinity.

DE 10 2005 059 240 A1 shows and describes a hydrostatic drive system with a variable-stroke pressure medium pump that supplies a consumer with pressure medium via control valves. In idle operation of the hydrostatic drive system in which the control valves are not actuated, a pressure compensator used as a circulation device is set to a minimum control pressure difference. The pressure medium pump is set to a minimum delivery volume, with the pressure medium flow that comes from the pressure medium pump flowing via the pressure compensator to a pressure medium tank with low power loss.

The hydraulic drive system has a complex structure and does not have minimized pressure losses.

DE 689 08 317 T2 describes a pressure control valve whose main valve is pilot-operated by a pilot valve located in a common valve housing.

SUMMARY OF THE INVENTION

An object of the invention is to provide an improved valve assembly for pressure control of a pressure medium that enables further minimization of the pressure loss when a consumer is not connected.

This object is basically achieved with a valve assembly for pressure control of a pressure medium from a pressure medium pump to a consumer and includes a pilot-operated pressure control valve with a spring-loaded main piston. A pilot piston that controls a valve seat for a fluid-carrying connection on a rear pressure chamber of the main piston is a component of the pressure control valve. The pressure chamber of the main piston on the piston back is pressurized via a first throttle in the main piston by the pump pressure so that the circulating pressure compensator formed in this way allows a comparison between the pump pressure and the pressure on the load sensor plus the spring pretensioning of the main control piston and of the pilot piston. A pressure of the pressure medium pump that is higher by the respective set spring tensions than the pressure on the load sensor of the consumer is established. Furthermore, according to the invention, a relief valve is provided for the space between the main piston and the pilot piston.

The relief valve is formed as a gate valve or seat valve, with a valve element of the relief valve being arranged such that at zero pressure of the load sensor, corresponding to the consumer in the off position, a flow of the pressure medium from the space between the main piston and pilot piston to a pressure medium vessel, tank, or into the LS line is enabled. During operation in unpressurized circulation, the relief valve is opened, and likewise the main valve can be opened. The pilot valve is closed in this case.

If the pressure on the load sensor rises above a set value at the relief valve, the relief valve closes the bypass formed in this way and enables a load sensing-controlled function of the pressure control valve according to the known prior art. The main valve and pilot valve are in the control position here.

The relief valve according to the invention thus enables a significant reduction of the pressure losses of the valve assembly compared to the known circuits of circulating pressure compensators.

In a travel position of the valve element of the relief valve, the pressure medium coming from the pressure medium port of the pressure control valve can be drained away via a first throttle and via the relief valve to the pressure medium tank. The pressure medium can be routed to the relief valve via a longitudinal channel between the pressure chamber of the main piston and another second pressure chamber that can be traversed by the pilot piston.

In one especially preferred exemplary embodiment of the valve assembly, the longitudinal channel has another second throttle. The second throttle then divides the longitudinal channel into two channel sections. A first channel section is assigned to the pressure chamber of the main piston in this case. A second channel section of the longitudinal channel is assigned fluidically to the second pressure chamber, which second pressure chamber can be traversed by the pilot piston. The second throttle can be used as a damping element for the relief valve. In one especially preferred exemplary embodiment, the relief valve is located in the housing of the pressure control valve. The valve element of the relief valve in this case is guided to be able to move axially in a longitudinal bore. A fluid-carrying connection to one channel section of the longitudinal channel or the other in at least one travel position of the valve element is established via at least one annular recess in the housing of the pressure control valve or in the valve element of the relief valve.

The valve element of the relief valve is preferably preloaded using an energy store (compression spring) in the direction of the second pressure chamber that can be traversed by the pilot piston. The pilot piston of the pilot valve can actuate a fluid-carrying connection between a load sensor LS and one free side of the valve element of the relief valve, which side is opposite the energy store. In partial load or full load operation of a consumer controlled using the pressure control valve and at a corresponding LS pressure, the valve element of the relief valve blocks a fluid-carrying connection between the pressure chamber of the main piston and the pressure medium tank. However, when the consumer is in the off position and at an LS pressure that approaches zero, the valve element of the relief valve conversely under the action of the energy store is moved into a travel position in which a direct fluid-carrying connection between the pressure chamber of the main piston is opened via the relief valve to the pressure medium tank. In this case, the pressure medium flows via the annular recess on the relief valve.

In a valve solution in which the annular recess in the housing or in the valve element discharges into the second channel section of the longitudinal channel between the pressure control valve and the pilot valve, the annular recess is linked at the second pressure chamber of the pilot piston or of the pressure chamber that can be traversed by the pilot piston to carry fluid.

Instead of an integrated construction of the pilot valve, main valve, and relief valve, a decentralized individual arrangement of the indicated valves into an overall valve assembly is possible. The relief valve can be located in a parallel arrangement to the pressure control valve between a pressure medium pump and the pressure medium tank. The relief valve can be pilot-operated directly. Alternatively and advantageously, the relief valve can be designed as an electrically actuatable 2/2-way valve that is actuated, for example, by a control and/or regulating device processing pressure signals of a pressure sensor.

Other objects, advantages and salient features of the present invention will become apparent from the following detailed description, which, taken in conjunction with the annexed drawings, discloses preferred embodiments of the present invention.

BRIEF DESCRIPTION OF THE DRAWINGS

Referring to the drawings which form a part of this disclosure.

DETAILED DESCRIPTION OF THE INVENTION

Figure 1A:
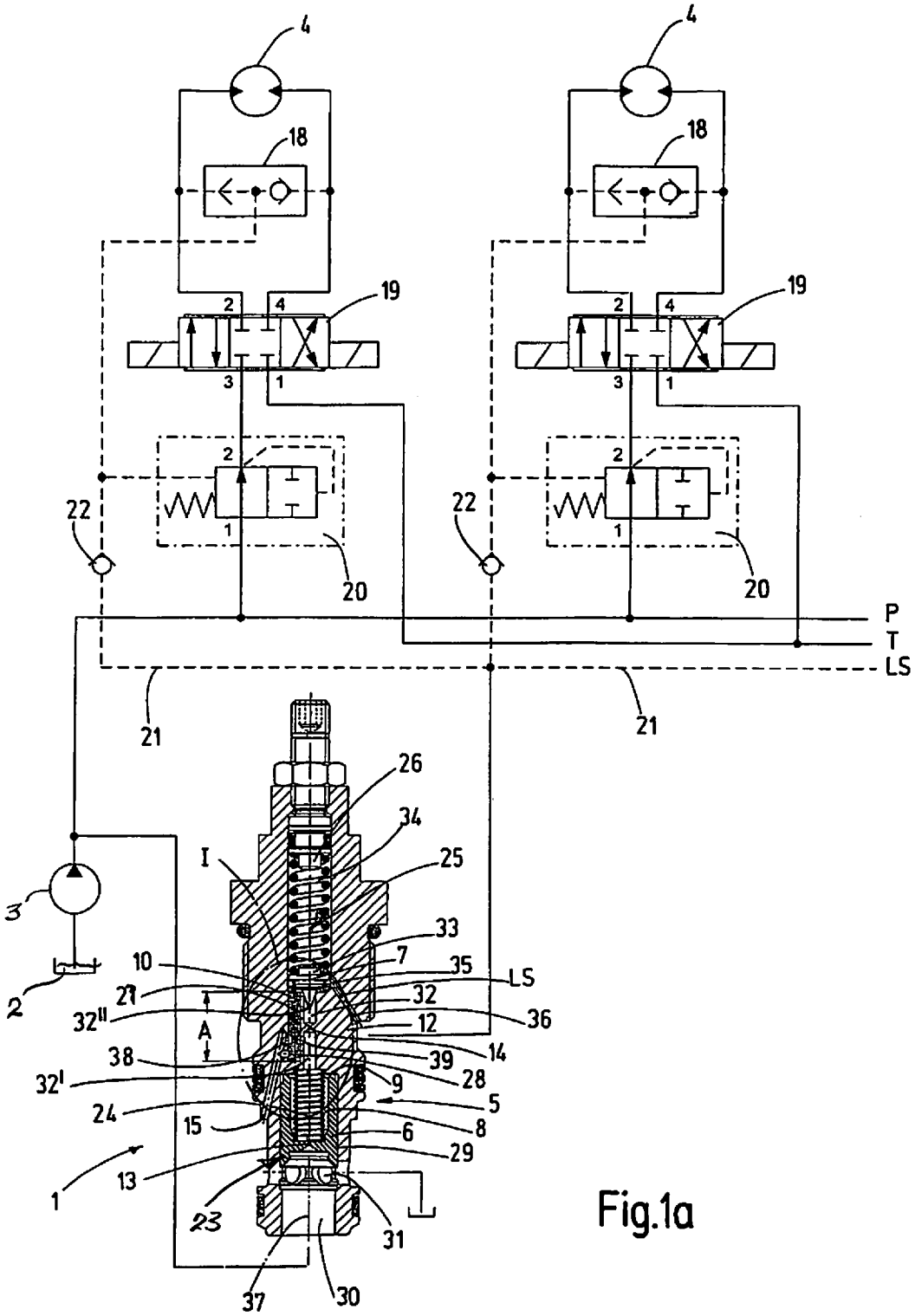
FIG. 1*a* is a schematic diagram of a valve assembly with a side elevational view in section, not to scale, of a pressure control valve assembly according to an exemplary embodiment of the invention with a relief valve in the opened operating position in a pressure control valve with linkage to a constant flow-pressure medium pump and to two consumers.

FIG. 1*a* shows a closed hydraulic circuit of a valve assembly 1, comprising a constant pressure medium delivery pump 3 for supplying a consumer 4 with pressure medium 2. The consumer 4 is shown as a hydraulic motor with two possible flow directions. The consumer 4 is actuated via an electrically actuated 4/3-way valve 19. The pressure prevailing on the consumer 4 is signaled to an LS line by a selector valve 18. A 2/2-way valve 20 with a pressure limiting function in the opened operating position is located upstream of this valve control.

In the exemplary embodiment of a hydraulic system shown in FIG. 1*a*, two consumers 4, each with identical valve control engineering, are connected in parallel and can be supplied by a constant pressure medium delivery pump 3. The manner of operation of the valve control block formed in this way for the consumers 4 will not be detailed here since it is adequately known from the prior art. The hydraulic system calls for a constant pressure medium delivery pump 3 as a more economical alternative to a variable delivery pump, but requires a control of its volumetric flow to be able to operate the consumer with a definable speed. A flow valve, especially a pressure control valve, is required, constituting altogether a simpler overall solution that is more economical than the one that results when using a variable delivery pump.

As FIG. 1*a* further shows, to display a load-independent constant speed of the two consumers 4, a single pressure control valve 5 with piloting, while taking into consideration a load sensor LS provided for the two consumers 4. The load sensor LS proceeds first separately on each selector valve 18 for each consumer 4 to display or indicate the consumer in the off position and in the operating position. Upstream of each selector valve 18 one check valve 22 at a time is connected to the hydraulic circuit into the control lines that can also be referred to as "load sensing" control lines 21. Each check valve 22 has the same set opening pressure and opens in the direction of the pressure control valve 5, especially in the direction to its load sensing port LS. This parallel connection of the control lines 21 with respect to the pressure control valve 5 enables a comparison of the two load pressures on the consumers 4, with the higher of the two possible load pressures being taken into account. In the pressure control valve 5, also shown in FIG. 1*c* and in another embodiment in FIG. 1*e*, a valve assembly 1 is provided with an additional relief valve 10, which additional relief valve in this respect is an important component of the solution according to the invention.

The operating principle of the pressure control valve 5 corresponds to a pilot-operated circulating pressure compensator 17, with three valves that are different in terms of operation being combined in a common housing 12. The fundamental functional linkage of the valves is also shown in a schematic circuit diagram in a detached construction. In particular, the three valves are the following:

- a main valve 23 with main piston 6 and a compression spring 24 that preloads it,
- a pilot valve 25 with a pilot piston 7 and a compression spring 26 that preloads it, and
- a relief valve 10 made as a miniature valve with a valve element 27 or relief valve piston and an energy store 28 that keeps it in the direction of a closed position.

In the cartridge-shaped housing 12 of the pressure control valve 5, which housing is designed as a cartridge valve, in a main valve control section, the main piston 6 is guided to move longitudinally in a bore 29 of the housing 12 in a main valve control section. The main piston 6 actuates or operates in a pressure medium inlet 30, by opening and blocking the fluid communication between inlet 30 and port 31, extending centrally and axially into the housing 12. A possible fluid-carrying connection can be established to a pressure medium port 31 extending radially out of the housing 12, optionally including several radially arranged passage bores in the housing 12 and able to be connected to a pressure medium tank 11 from which the pressure medium pump 3 takes pressure medium for the hydraulic circuit.

Figure 1B:
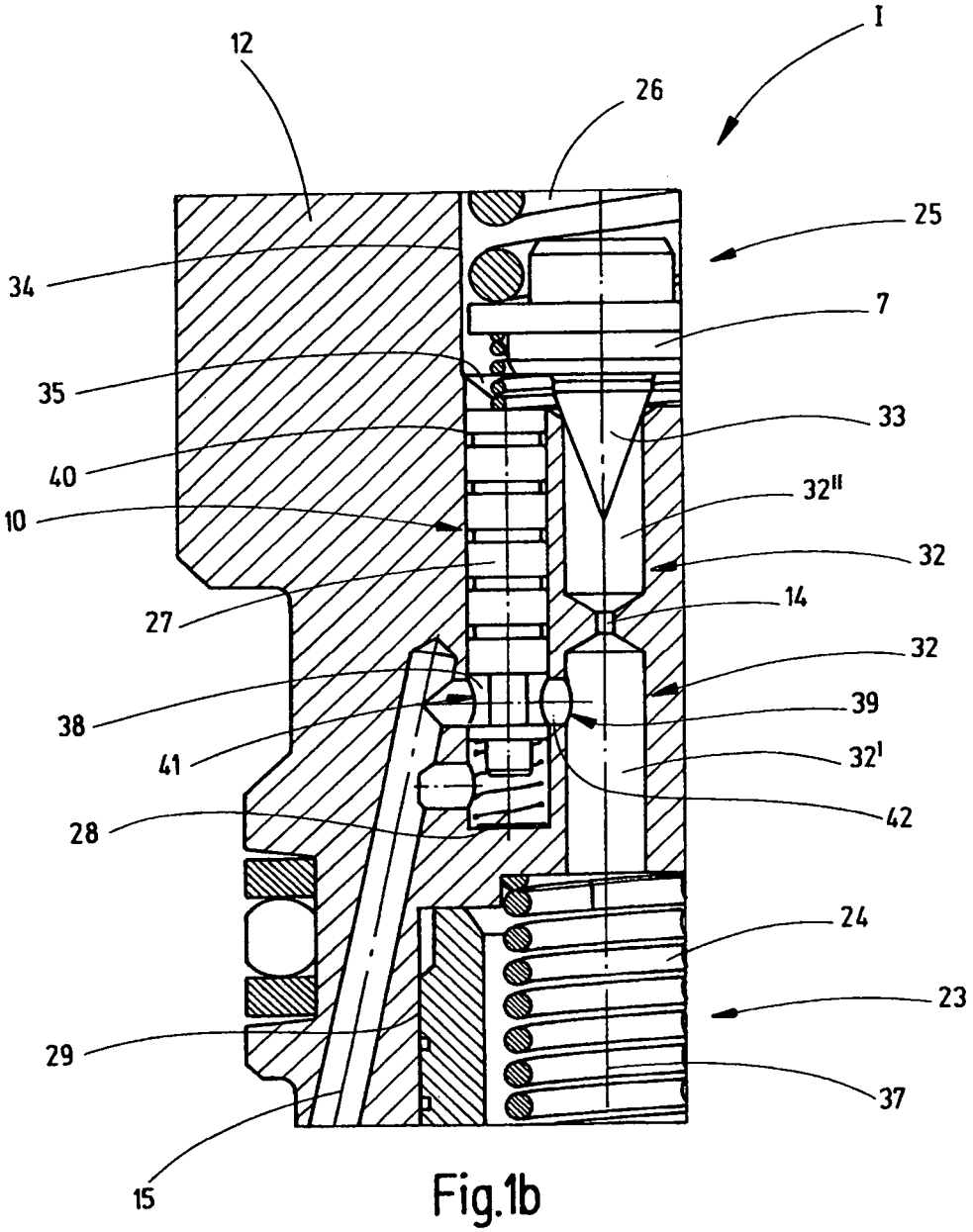
FIG. 1*b* is an enlarged side elevational view in section of detail I in FIG. 1*a;*

The main valve 23 is designed with reference to its effective cross section such that the entire volumetric flow of the pressure medium 2 can be conveyed to the pressure medium tank 11 by the constant pressure medium delivery pump 3. In the main piston's 6 piston bottom, a first throttle 13 has the form of a through opening or bore with a definable diameter. This throttle 13 enables the pressure on the piston back 9 of the main piston 6 to be signaled, which pressure is prevailing on the pump side. The main piston 6 is designed essentially as a cylindrical sleeve with a piston bottom as fluid separation so that on the back 9 of the piston a cup-shaped pressure chamber 8 is formed and is used for centering and accommodating the compression spring 24 and for accommodating the pressure medium 2. In the axial direction of the pressure control valve 5, a bore 32 with a diameter of roughly ⅕ of the main piston 6 in the valve housing 12 is made in the center. The bore 32 in roughly its axial center has another second throttle 14. The second throttle 14 divides the bore 32 into a first channel section 32' and a second channel section 32". As FIGS. 1*b, d*, and *f* each show in respective details I, the first channel section 32' is assigned to the pressure chamber 8 of the main valve 23, whereas the second channel section 32" is assigned to a second pressure chamber 35 that can be traversed by the pilot piston 7.

The pilot piston 7 in turn is formed as a flat disk with a centering aid 33 in the form of a truncated cone for a compression spring 26. The pilot piston 7 is exposed to the force of the compression spring 26 supported with radial play in a bore 34 for the pilot piston 7 and the compression spring 26. The second pressure chamber 35, on the front side of the pilot piston 7, is the same pressure chamber as the space 34 in which the compression spring 26 is placed. Hence, a seal is not required. A bore 36 traversing the wall of the housing 12 for the load sensor LS of the consumer 4 discharges into the space 34 of the pilot piston 7. The flow pressure of the pilot valve 25 arises from the pressure defined by the compression spring 26 plus the pressure on the load sensor LS. If the pump pressure is greater than the pressure from LS and the pressure set by the spring 24 of the main piston and set by the compression spring 26 of the pilot piston 7, the pilot valve 25 and consequently the main valve 23 open and the pressure medium can flow out via the main valve 23 to the pressure medium tank 11.

As FIGS. 1*a* to 1*f* further show, the relief valve 10 with a valve element 27, located in an axial region A in a longitudinal bore 40 is able to move between the pilot valve 25 and the main valve 23, and is connected, in particular, in parallel to the pressure control valve 5. The relief valve 10, shown enlarged in FIGS. 1*b, d*, and *f* is incorporated into the housing 12, is located radially offset laterally to a longitudinal axis 37 of the valve housing 12 and has a diameter roughly identical to the load bore formed by the bore 32 above and below the second throttle 14. A valve element 27 or a relief valve piston is shown striking an upper stop on which it terminates more or less flush with the end of the bore 34 for the accommodation of the pilot piston 7. The positions of the relief valve piston which are shown in FIGS. 1*a*, 1*b*, 1*e*, and 1*f* correspond to an opened operating position of the relief valve 10. The relief valve piston is sprung or biased by a smaller energy store 28, a compression spring that, for example, applies a flow pressure of 0.5 bar on its opposite face side in the sense of an opened position.

In the axial vicinity to the compression spring-side end of the relief valve piston, an annular recess 41 is formed as an annular groove 38 in the periphery of the relief valve piston. In the exemplary embodiment of the valve assembly 1 shown in FIGS. 1*a*, 1*b*, 1*c*, and 1*d*, the annular recess 41 communicates with the first channel section 32' of the bore 32. If, at this point, there is no longer any pressure on the load sensor LS on the side facing away from the load sensor side of the pilot valve piston 7 and thus facing away from the compression spring 28, the relief valve piston assumes the position shown in FIGS. 1*a*, 1*e*, and 1*f*. The annular groove 38 overlaps an assigned opening 39 of the bore 34. The pressure medium can thus be routed or conveyed from the pressure chamber 8 on the back 9 of the main piston 6 via the bore 32, the opening 39 and a connecting line 42 communicating with the opening in the housing 12 via the annular groove 38 to a discharge 15 of the relief valve 10. The pressure medium 2 then flows out unpressurized without the pressure medium pump 3 having to deliver against the set pressure on the pilot valve 25. This design measure saves considerable energy in the operation of the hydraulic system equipped with a valve assembly 1 according to the invention when the consumer 4 is shut off. If the pressure on the load sensor LS rises when the consumer 4 is restarted, the relief valve piston travels against the spring force of its compression spring 26 into the position shown in FIGS. 1*c* and 1*d* closing the opening 39 and the connecting line 42 with the annular groove 38. The pressure control valve 5 in its above-described control operation is not influenced by the relief valve 10.

Figure 1C:
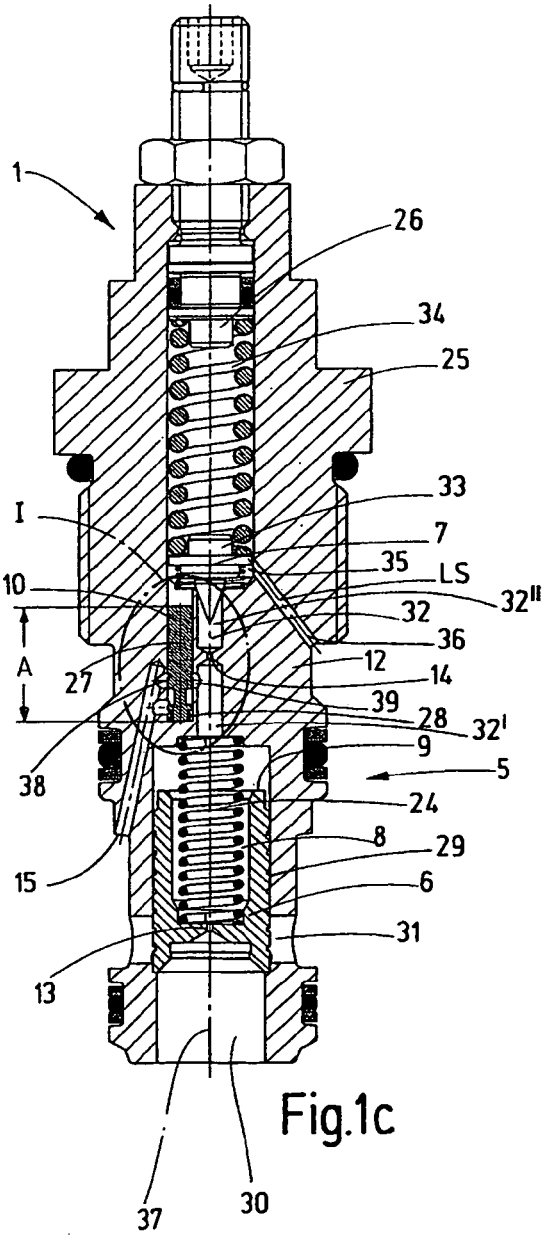
FIG. 1*c* is a schematic side elevational view in section, not to scale, of the pressure control valve assembly of FIG. 1 with the relief valve in the control position of the main valve and of the pilot valve with the closed operating position of the relief valve.
Figure 1E:
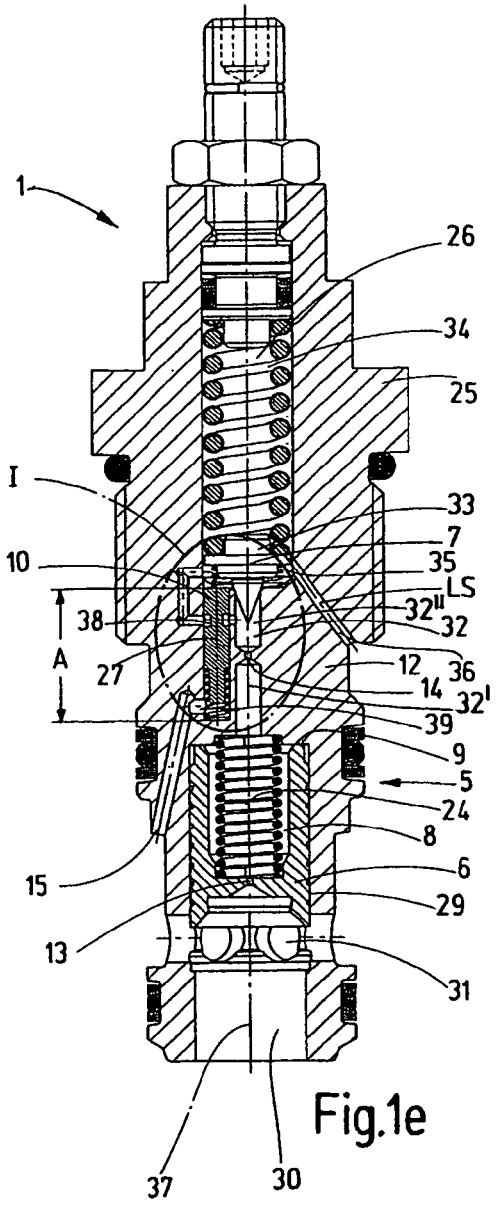
FIG. 1*e* is a side elevational view in section of a pressure control valve according to a second exemplary embodiment of the invention with a relief valve.
Figure 1D:
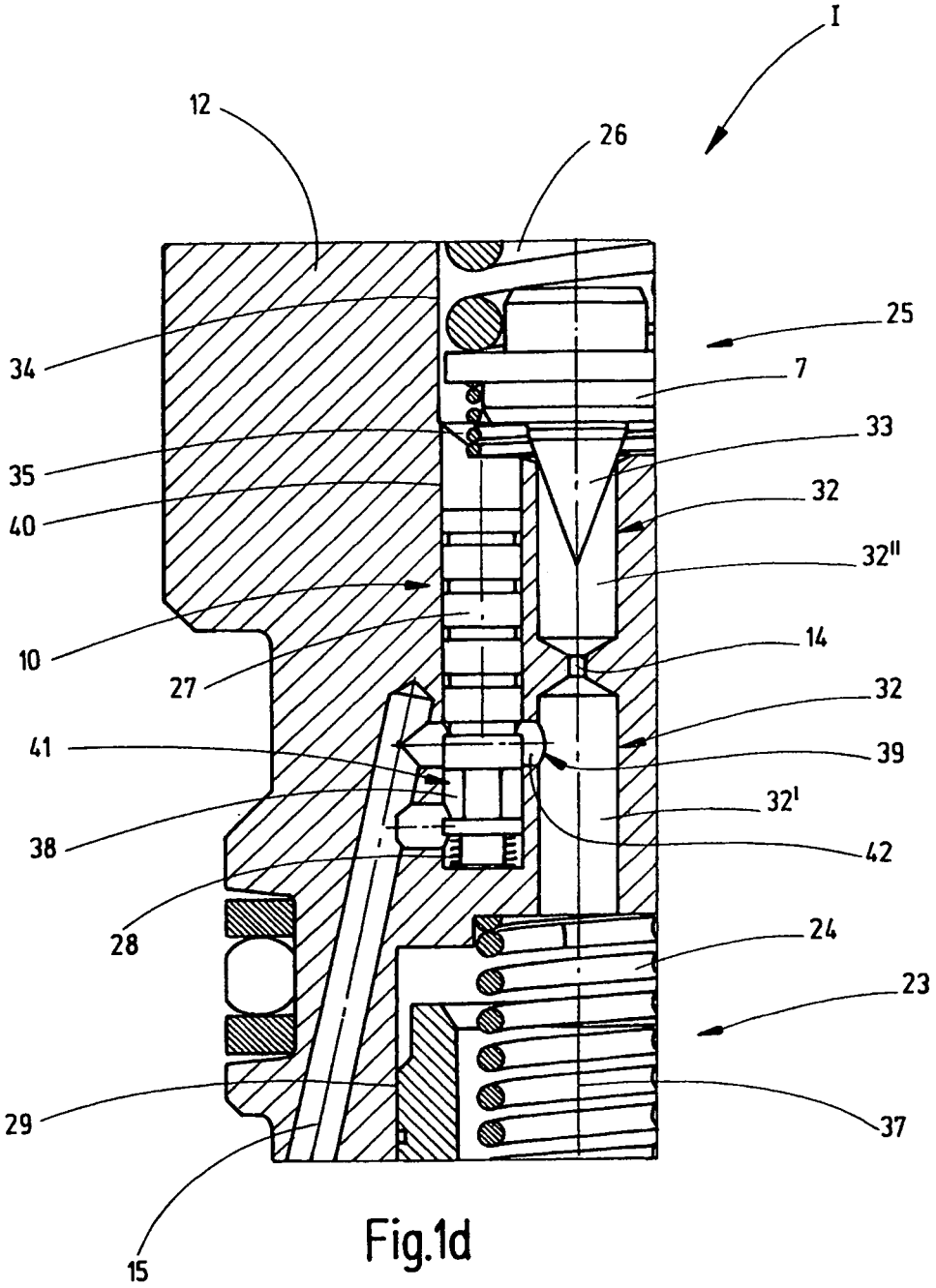
FIG. 1*d* is an enlarged side elevational view in section of detail I in FIG. 1*c;*
Figure 1F:
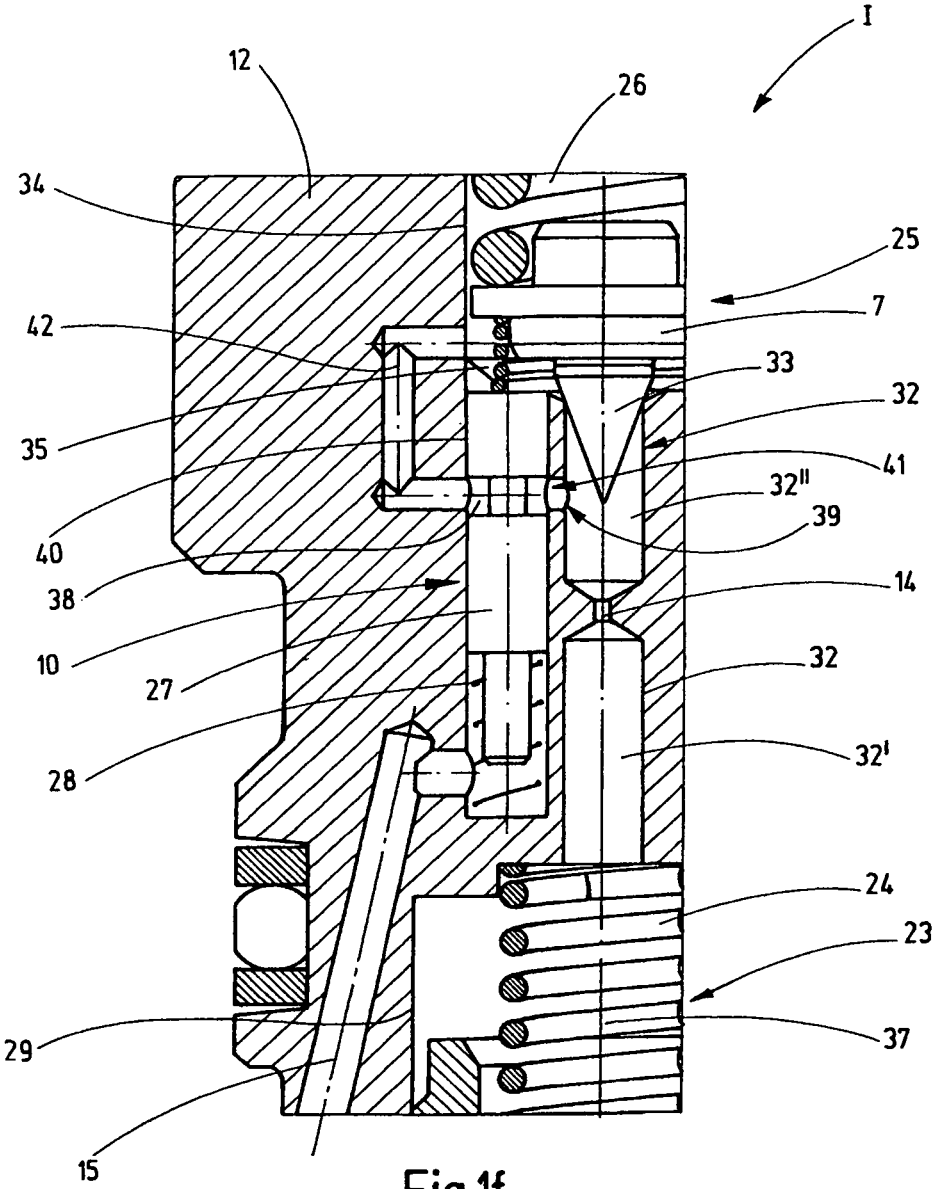
FIG. 1*f* is a side elevational view in section of detail I in FIG. 1*e;*

FIGS. 1*e* and 1*f* in turn show in a schematic longitudinal section (not to scale) a version of a valve assembly 1 modified relative to FIGS. 1*a*, 1*b*, 1*c*, and 1*d*, in turn combined in a housing 12 of the pressure control valve 5 with an offset opening 39 to the extent that the drainage of the pressure medium 2 out of the pressure chamber 8 into the LS line is ensured to take place. In this exemplary embodiment, the opening 39 is assigned to the second channel section 32". The second throttle 14 thus acts in a damping manner on the entire operation of the valve assembly 1, especially on the main piston 6.

Figure 2:
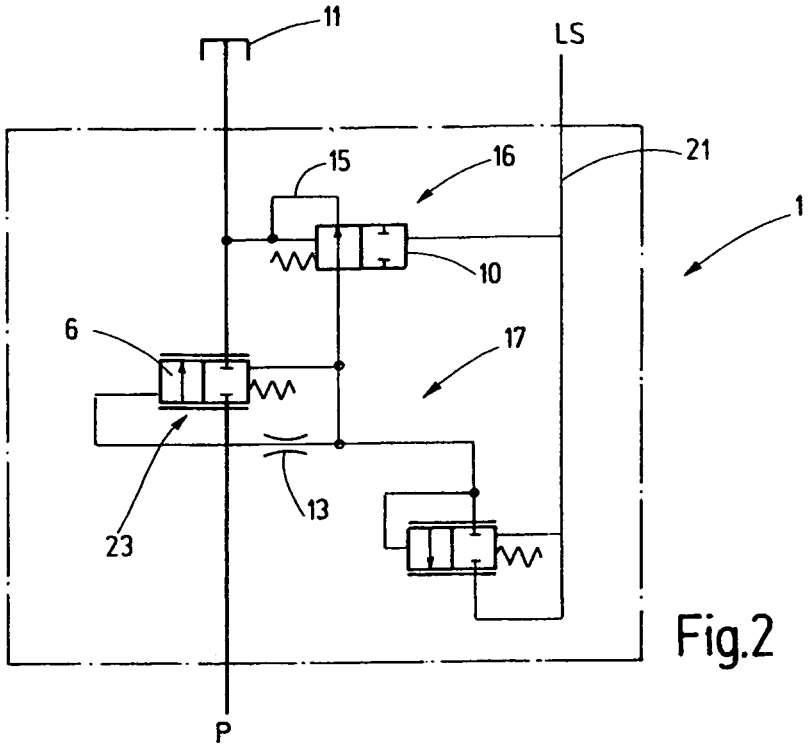
FIG. 2 is a hydraulic circuit diagram of the valve assembly according to a third exemplary embodiment of the invention.
Figure 3:
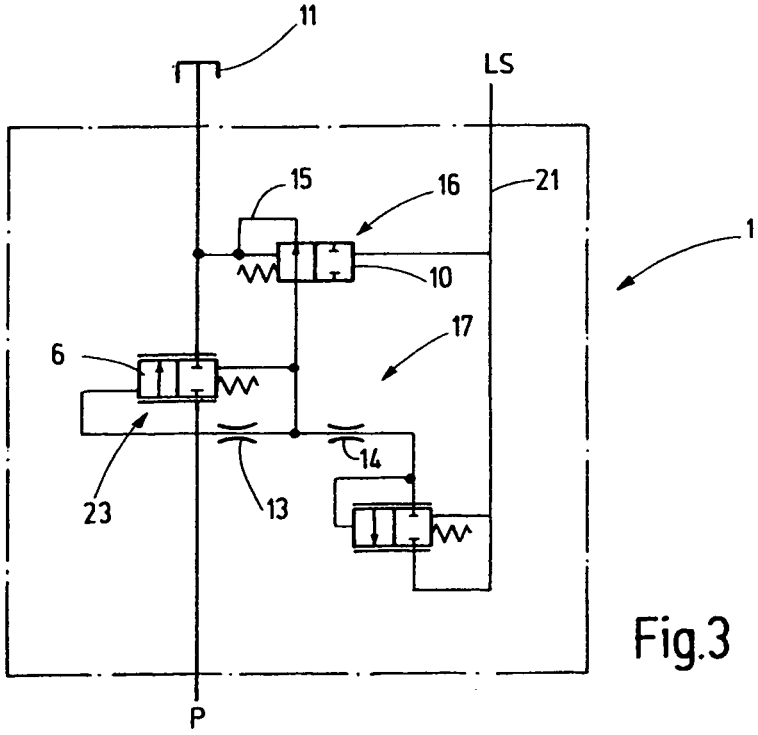
FIG. 3 is a hydraulic circuit diagram of a valve assembly with a connection of a relief valve downstream of a first throttle and upstream of a second throttle between the main control valve and the pilot valve of the pressure control valve according to a fourth exemplary embodiment of the invention.

FIGS. 2 and 3 show the interconnection of the three valves 10, 23, and 25 with a pressure medium sensor according to the solutions shown in FIGS. 1*a* and 1*c*. In this way, the valve assembly 1 according to the invention can also be implemented in an unattached valve design.

Figure 4:
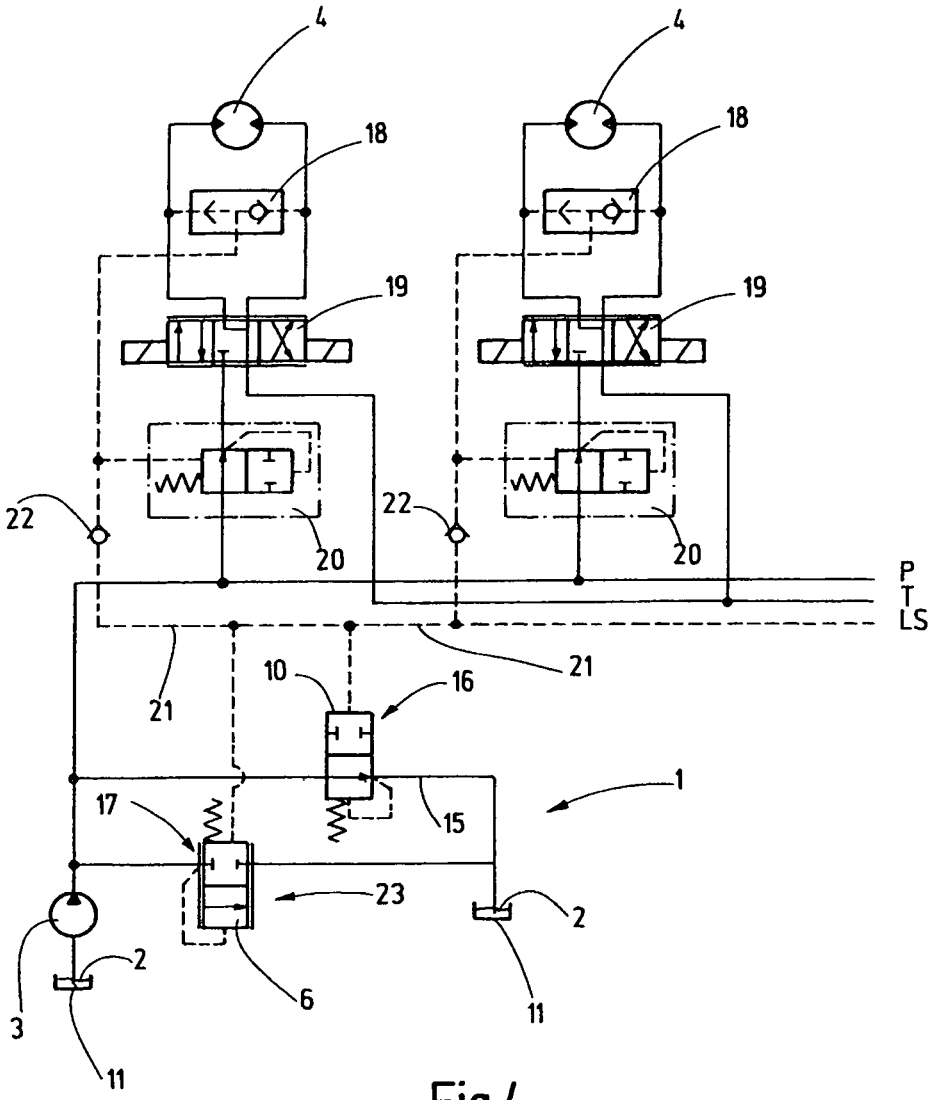
FIG. 4 is a hydraulic circuit diagram of a valve assembly according to a fifth exemplary embodiment of the invention.
Figure 5:
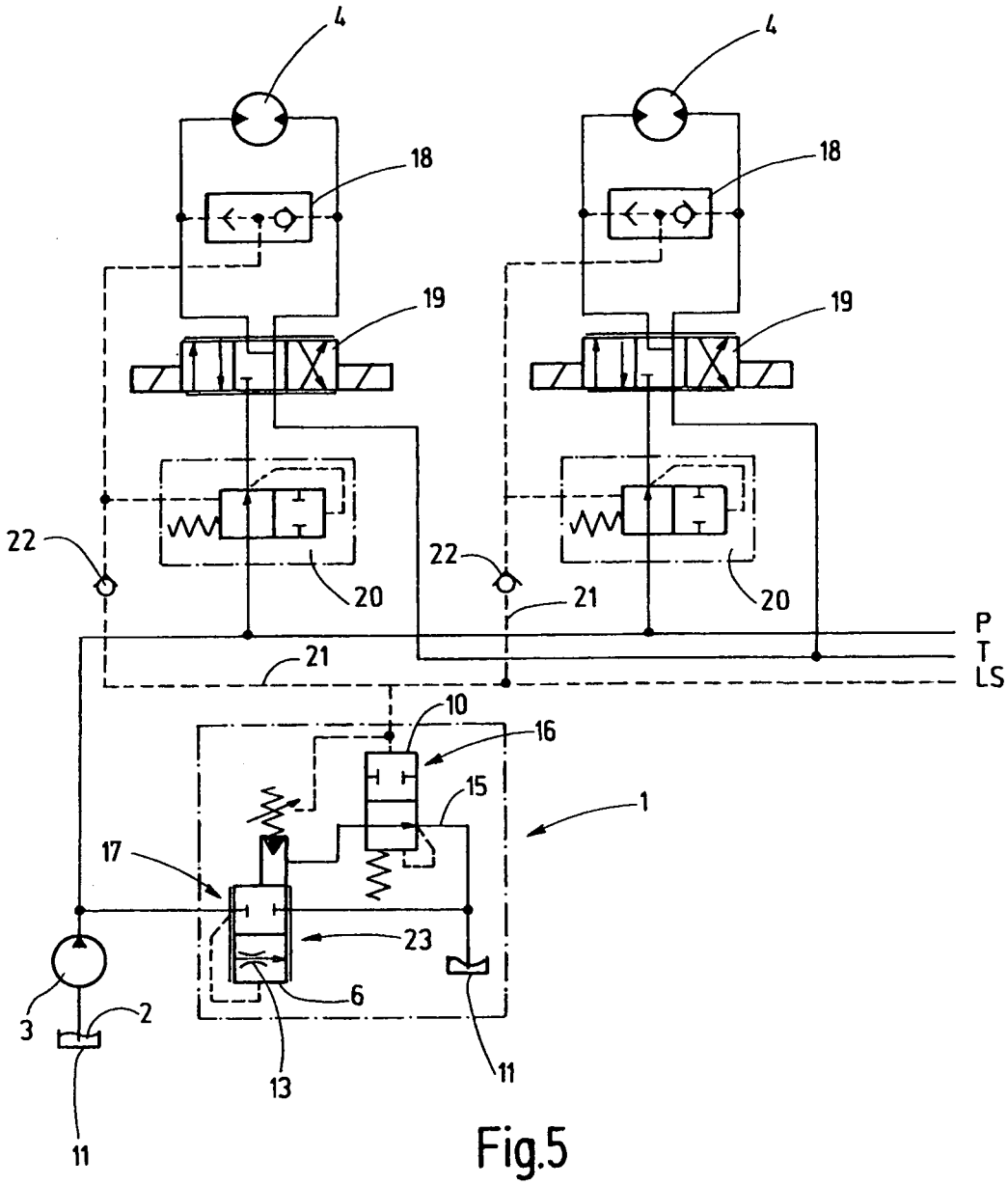
FIG. 5 is a hydraulic circuit diagram of a valve assembly according to a sixth exemplary embodiment of the invention.

FIGS. 4 and 5 in turn show a circuit diagram comparable to FIG. 3, with the relief valve 10 being able to be designed as 2/2-way valve 16, implemented for the entire volumetric flow of the pressure medium pump 3.

The relief valve can generally be integrated into an existing pressure control valve as a valve of compact size. Advantageously, the relief valve can be arranged axially between the pilot valve and the main valve with a valve piston of the relief valve being insertable into the housing of the pressure control valve from the pilot valve side. In this way, the main bore for the relief valve can be produced from the same valve side as a throttle between the pressure chamber and the pilot valve.

While various embodiments have been chosen to illustrate the invention, it will be understood by those skilled in the art that various changes and modifications can be made therein without departing from the scope of the invention as defined in the appended claims.

What is claimed is:

1. A valve assembly for pressure control of a pressure medium from a pressure medium pump to at least one consumer, comprising:

a pilot-operated pressure control valve having a main piston pressurizable by the pressure medium, having a pilot piston and having a first pressure chamber between a back of said main piston and said pilot piston that can be relieved; and a relief valve connected for carrying fluid to said first pressure chamber and opening at a pressure of a medium pressure on a load sensor corresponding to an off position of the consumer, said relief valve returning pressure medium having a low pressure into at least one of a pressure medium tank and the pressure medium pump, said relief valve closing when pressure of the pressure medium on said load sensor corresponds to the consumer in an operating position thereof.

2. A valve assembly according to claim 1 wherein said control valve having a pressure medium port receiving pressure medium and conveying that pressure medium via a first throttle and via said relief valve for drainage to the pressure medium tank.

3. A valve assembly according to claim 2 wherein a longitudinal channel extends between said first pressure chamber of said main piston and a second pressure chamber traversed by said pilot piston, said longitudinal channel having a second throttle therein.

4. A valve assembly according to claim 3 wherein said second throttle divides said longitudinal channel into first and second channel sections thereof, said first channel section opens on said first pressure chamber, said second channel section opens on said second pressure chamber.

5. A valve assembly according to claim 4 wherein said relief valve comprises a valve element guided for movement in a longitudinal bore of a housing of said pressure control valve; and at least one annular recess in at least one of said housing and said valve element establishes a fluid-carrying connection to at least one of said first and second channel sections in at least one travel position of said valve channel.

6. A valve assembly according to claim 5 wherein said valve element is biased by a compression spring to be preloaded in a direction of said second pressure chamber with said pilot piston; and said pilot piston actuates a fluid-carrying connection between said load sensor and a free side of said valve element, said free side being opposite said compression spring.

7. A valve assembly according to claim 5 wherein said valve element blocks said fluid-carrying connection between said first pressure chamber and the pressure medium tank at least when fully exposed to pressure of said load sensor and clears said fluid-carrying connection between said first pressure chamber and the pressure medium tank when not so fully exposed.

8. A valve assembly according to claim 5 wherein said annular recess discharges into said second channel section and is connected to said second pressure chamber of said pilot piston via a connecting line.

* * * * *